US006746536B2

(12) United States Patent
Hess

(10) Patent No.: US 6,746,536 B2
(45) Date of Patent: Jun. 8, 2004

(54) LIQUID COATING DEVICE WITH ROTATING SPRAY DISKS

(75) Inventor: Günter Hess, Reutlingen (DE)

(73) Assignee: Weitmann & Konrad GmbH & Co. KG, Leinfelden-Echterdingen (DE)

( * ) Notice: Subject to any disclaimer, the term of this patent is extended or adjusted under 35 U.S.C. 154(b) by 0 days.

(21) Appl. No.: 10/415,152

(22) PCT Filed: Aug. 21, 2001

(86) PCT No.: PCT/EP01/09621

§ 371 (c)(1),
(2), (4) Date: Apr. 25, 2003

(87) PCT Pub. No.: WO02/34518

PCT Pub. Date: May 2, 2002

(65) Prior Publication Data

US 2004/0020425 A1 Feb. 5, 2004

(30) Foreign Application Priority Data

Oct. 27, 2000 (DE) ..... 100 53 305.1

(51) Int. Cl.[7] ..... B05C 5/00; B05C 11/00
(52) U.S. Cl. ..... 118/325; 118/612
(58) Field of Search ..... 118/325, 320, 118/321, 612, 52, 53, 501; 384/537, 618; 134/64 R, 122 R

(56) References Cited

U.S. PATENT DOCUMENTS

| | | | | |
|---|---|---|---|---|
| 2,865,324 A | | 12/1958 | Stein | |
| 3,125,296 A | | 3/1964 | Gold | |
| 3,749,313 A | * | 7/1973 | Weitmann | 239/127 |
| 5,052,827 A | * | 10/1991 | Huiskamp et al. | 384/448 |
| 5,066,147 A | * | 11/1991 | Brandenstein et al. | 384/585 |
| 5,778,911 A | | 7/1998 | Yoshio | |
| 6,547,883 B2 | * | 4/2003 | Molnar et al. | 118/325 |

FOREIGN PATENT DOCUMENTS

| | | |
|---|---|---|
| DE | 20 58 667 | 5/1972 |
| DE | 258 948 | 8/1988 |
| DE | 44 11 058 | 10/1995 |
| EP | 0 022 333 | 1/1981 |
| EP | 0 142 377 | 5/1985 |
| EP | 0 246 032 | 11/1987 |
| EP | 0 796 662 | 9/1997 |
| FR | 2 104 711 | 4/1972 |

* cited by examiner

*Primary Examiner*—Richard Crispino
*Assistant Examiner*—Yewebdar Tadesse
(74) *Attorney, Agent, or Firm*—Paul Vincent

(57) ABSTRACT

The invention relates to a liquid coating device (10) comprising a rotor housing (12) accommodating one or more spray rotors (22). The spray rotors (22) comprise a drive device (46), a drive shaft (42), a bearing element (50) and a spray disk (38). The spray disk (38) is arranged above the bearing element (50). According to the invention, maintenance and lifespan of the liquid coating device (10) are improved significantly.

18 Claims, 1 Drawing Sheet

LIQUID COATING DEVICE WITH ROTATING SPRAY DISKS

BACKGROUND OF THE INVENTION

The invention concerns a liquid coating device for applying liquid to moving surfaces, with a rotor housing comprising at least one or more spray rotors, each spray rotor comprising a drive means, a drive shaft projecting from the drive means, a bearing element for the drive shaft and a spray disk driven by the drive shaft, wherein the spray disk is substantially formed like a pan and has an upwardly facing opening.

DE-A-20 58 667 discloses a device for applying liquid onto moving surfaces which comprises a rotor housing containing a plurality of spray disks. These spray disks each have a vertical axis of rotation, wherein the axes of rotation terminate at their upper ends in a V-belt pulley. This V-belt pulley is driven via one single V-belt. A bearing box is located below this drive which bears the entire rotation unit on the rotor housing. The pan-shaped spray disk which is open at the top and into which the liquid to be sprayed is introduced via a line, is located below this bearing box.

It has turned out that cleaning of the overall spray device is relatively complicated since dismantling of the spray disk requires dismantling of the belt pulley and of the entire bearing. The bearing is moreover located in the spray region of the liquid to be sprayed which can reduce the service life of the bearing elements.

It is therefore the underlying purpose of the present invention to provide a liquid coating device of the above-mentioned type with which cleaning of the spray disk and of the entire spray region is considerably facilitated and which has a longer service life.

SUMMARY OF THE INVENTION

This object is achieved in accordance with the invention with a liquid coating device of the above-mentioned type in that, in the predominant position of use of the device, the spray disk is disposed substantially above the drive means.

In another solution, the opening of the spray disk faces away from the drive means.

In yet another solution, the rotor housing comprises a separating wall which separates the bearing element from the spray disk.

The above-mentioned variants of the inventive application device considerably facilitate cleaning of the spray disk and of the entire spray region, since the spray disk is disposed above the drive means and can be accessed from the top. Only the lid of the rotor housing must be removed to provide access to the spray disks from above. Dismantling of the entire drive, in particular of the belt pulley, is no longer required since it is located below the spray disk. The easily accessible spray disks can be cleaned and also exchanged e.g. by removing them from the drive shaft.

The bearings are protected since the opening of the spray disk faces away from the drive means. The liquid is thrown from the spray disk substantially outwardly and upwardly, and therefore the bearing or its annular clearance is no longer in the direct flow or spray region of the liquid to be sprayed.

Finally, the third embodiment of the invention has the advantage that the region where the spray disk is located and where the liquid is sprayed and whirled, is separated by a separating wall from the bearing element. For this reason, the bearing element and therefore the entire drive unit are separated from the spray disk (located in a separate space). This embodiment is particularly advantageous when aggressive liquids are used since they are prevented from reaching the bearing and drive parts.

In a further development, the spray disk is mounted on the drive shaft. This has the substantial advantage that the spray disk can be replaced by a new or a different spray disk in a relatively easy fashion such that when e.g. the spray disk is soiled, it can be removed and a new spray disk can be mounted on the drive shaft. Exchange of spray disks moreover permits relatively easy adjustment to the liquid to be sprayed or to the amount of liquid.

To ensure safe connection between the spray disk and drive shaft, rotary carriers are provided which are disposed on the drive shaft or on the spray disk and are adapted to the respective other component. These rotary carriers ensure easy coupling between the spray disk and the drive shaft and also slip-free rotational carrying along of the spray disk.

In order to avoid intercepting the liquid sprayed in the spraying direction, the rotor housing has a liquid tub extending above the drive means and below the spray disk. This tub is advantageously formed as separating wall and prevents liquid, spray or the like from passing directly from the region of the spray disk to the drive region accommodating the bearing. The liquid tub which collects the liquid not sprayed, divides the rotor housing into a dry drive region and a moist spray region.

Advantageously, a liquid supply is provided from above and feeds onto the spray disk. This liquid supply is located exclusively within the region where the spray disks are provided and the liquid line does not have to be guided through a separating wall or a liquid tub.

In one embodiment, the liquid is advantageously supplied centrally on the spray disk. This is substantially advantageous in that the liquid which is supplied exactly at the center, is uniformly distributed on the spray disk.

In a preferred embodiment, the bearing element has an inner ring connected to the rotor housing and an outer ring connected to the drive shaft. The inner ring and the outer ring are thereby parts of a roller or sliding bearing. The inner ring is preferably connected to the liquid tub of the rotor housing via a sleeve. Via this sleeve, the inner ring is rigidly clamped to the liquid tub or the separating wall of the rotor housing, whereas the outer ring seats in a corresponding receiving bore of the drive means. The drive belts engage the outside, i.e. the periphery, of this drive means and the drive means is provided with the central drive shaft which is guided without contact through the sleeve to drive the spray disk.

The sleeve preferably has a cover which overlaps and covers the upper side of the inner ring and outer ring of the bearing. This prevents e.g. condensed liquid from dripping into the bearing from above.

In accordance with one preferred embodiment, the lower end of the sleeve and/or the drive means may be provided with a liquid outlet such that the liquid entering the sleeve can be easily drained from the bottom. A further liquid outlet is also provided at which the edge of the cover terminates. This liquid outlet may be provided within the bearing element to prevent liquid dripping from the cover from being guided past the bearing element and onto the belt pulley. The overall bearing element may be provided with a labyrinth for leaking liquid. This labyrinth prevents liquid from entering the bearing and ensures that the liquid is quickly guided out of the bearing element.

In a further development, the spray disk has a downwardly extending apron on its lower side which is immersed into a liquid bath of a liquid tub. The apron immersed into the liquid bath serves as a vapor lock, preventing liquid vapor from entering the bearing element via the sleeve.

Further advantages, features and details of the invention can be extracted from the following description which describes in detail a particularly preferred embodiment with reference to the drawing. The features shown in the drawing and mentioned in the description and claims may be essential to the invention individually or collectively in arbitrary combination. In particular, the three different solutions may be combined. The drawing shows a section through the inventive liquid coating device.

BRIEF DESCRIPTION OF THE DRAWING

The sole FIGURE shows a cross section of the liquid coating device in accordance with the invention.

DESCRIPTION OF THE PREFERRED EMBODIMENT

Figure 1:
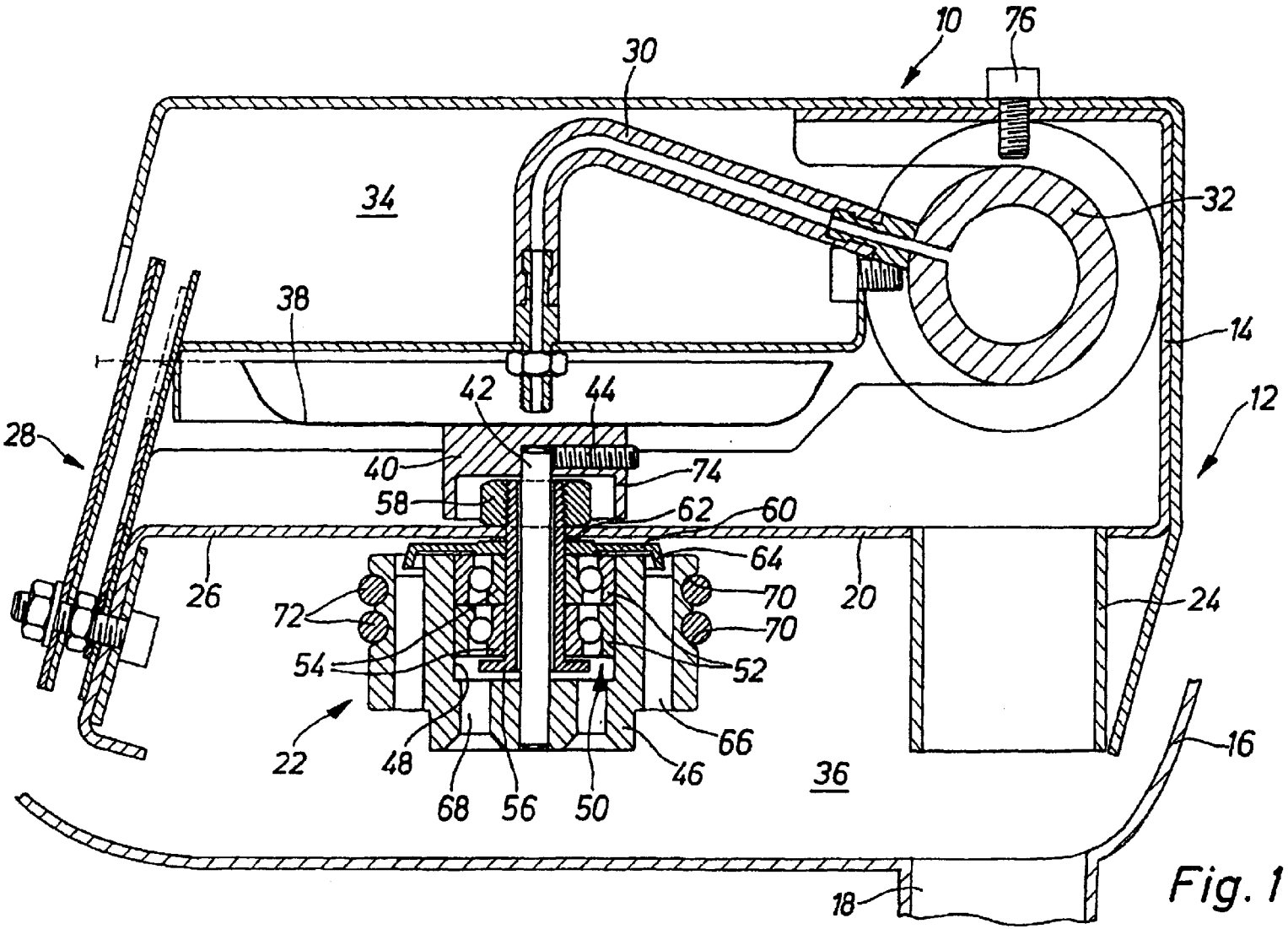

FIG. 1 shows a cross-section through a liquid coating device, referred to in its totality with 10, which is e.g. used in printing machines to moisten paper webs. These devices are also used in the textile industry to spray liquid onto fabric sheets. The liquid coating device 10 has a rotor housing 12 which consists generally of sheet metal and has an upper part 14 and a lower part 16. The lower part 16 is substantially formed as collecting tub and has an outlet 18 through which the collected liquid can drain. The upper part 14 has a separating wall 20 to which a plurality of spray rotors 22 are mounted. The upper part 14 also has an outlet 24 which feeds into the outlet 18. The separating wall 20 is also formed as liquid tub 26 with one side wall of that liquid tub 26 being formed by a slider strip 28. The slider strip 28 adjusts the size of a diaphragm opening through which the liquid is sprayed from the liquid coating device 10. Another liquid supply 30 is located within the upper part 14 and is fed by a supply line 32. FIG. 1 clearly shows that the wall 20 separates the inner space of the upper part 14, which contains liquid, from a space which is located below the separating wall 20 and contains no liquid. The separating wall 20 separates a spray region 34 from a drive region 36.

The spray region 34 has a spray disk 38 which is mounted to a coupling element 40 at the upper end of a drive shaft 42. This is effected either with a set screw 44 or a rotary carrier which are either provided on the coupling element 40 or on the drive shaft 42. In any event, the spray disk 38 can be easily mounted and fastened to the upper end of the drive shaft 42 via the coupling element 40. The spray disk 38 is provided centrally with liquid via the liquid supply 30. The liquid is disposed in the center of the spray disk 38 so that it can be evenly distributed.

The drive shaft 42 is pressed into a drive means 46 which is located below the separating wall 20 and therefore within the drive region 36. The drive means 46 has a central bore 48 into which two roller bearings 50 are pressed. The outer rings 52 of the roller bearings 50 are rigidly connected to the drive means 46. The inner rings 54 of the roller bearings 50 are disposed on a sleeve 56 for secure mutual rotation therewith, wherein the sleeve penetrates the separating wall 20 from below via a bore. The upper end of the sleeve 56 is provided with an outer thread and bears a nut 58. A cover 60 and a seal 62 are disposed on the sleeve. Tensioning of the nut 58 rigidly connects, via the sleeve 56, the inner rings 54, the cover 60 and seal 62 to the separating wall 20 and therefore to the rotor housing 12.

The edge 64 of the cover 60 is downwardly angled and feeds a liquid outlet 66 in the drive means 46. The cover 60 covers the upper side of the roller bearings 50 to prevent liquid from getting into the roller bearings 50 from above.

The drive shaft 42 penetrates through the sleeve 56 with play and the drive means 46 is provided with additional liquid outlets 68 below the roller bearings 50 with which the free space between the sleeve 56 and the drive shaft 42 communicates. Liquid penetrating into the sleeve 56 can exit the drive means 46 through these liquid outlets 68.

The circumference of the drive means 46 is provided with two peripheral grooves 70 in which the drive belts 72 are disposed. The spray rotor shown in the drawing is thereby driven via one drive belt by a neighboring spray rotor and drives the other neighboring spray rotor via the other drive belt. To provide for an equilibrium of moments, four peripheral grooves may be provided wherein an outer belt pair is coupled after each inner belt pair. Since the spray rotors 22 have identical mutual lateral separations, the drive belts 72 have identical lengths. The drive belts 72 surround only two spray rotors 22 and are therefore not mutually subjected to bending strain which increases their service life.

The lower side of the coupling element 40 has a peripheral apron 74 whose lower end is located in the region of the bottom of the liquid tub 26. When the liquid tub 26 is filled with liquid, the lower edge of the apron 74 is immersed into this liquid thereby forming a barrier which prevents even the finest of liquid drops from getting into the drive means 46 via the sleeve 56. The apron 74 therefore generates a vapor lock.

The drawing clearly shows that a lid 78 can be removed from the upper part 14 after releasing the mounting screw 76. The spray rotors 22, in particular the spray disk 38 can then be accessed from the top. The entire spray region 45 can also be cleaned.

The inventive liquid coating device 10 can be operated not only in the orientation shown in the drawing. The device 10 may be inclined at an angle so the the objects to be sprayed can also be sprayed from the top or from below. This angle may be up to 90°.

I claim:

1. A liquid coating device for applying liquid onto moving surfaces, the device comprising:

a rotor housing;

at least one spray rotor disposed within said rotor housing, said spray rotor having a drive means, a drive shaft projecting from said drive means, a bearing element for said drive shaft and a spray disk driven by said drive shaft, wherein said spray disk is substantially pan-shaped and has an upper opening, wherein said bearing element has an inner ring connected to said rotor housing and an outer ring connected to said drive shaft, wherein said inner ring and said outer ring are parts of a roller or sliding bearing.

2. The liquid coating device of claim 1, wherein said spray disk is disposed substantially above said drive means in a position of use of the device.

3. The liquid coating device of claim 1, wherein said upper opening of said spray disk faces away from said drive means.

4. The liquid coating device of claim 1, wherein the rotor housing has a separating wall which separates said bearing element from said spray disk.

5. The liquid coating device of claim 1, wherein said spray disk is mounted on said drive shaft.

6. The liquid coating device of claim 1, further comprising a rotary carrier disposed on one of said drive shaft and said spray disk.

7. The liquid coating device of claim 1, wherein said rotor housing has a liquid tub disposed above said drive means and below said spray disk.

8. The liquid coating device of claim 7, wherein said liquid tub separates said rotor housing into a drive region and into a spray region.

9. The liquid coating device of claim 7, wherein said inner ring is connected to said liquid tub of said rotor housing via a sleeve.

10. The liquid coating device of claim 9, wherein said drive shaft penetrates through said sleeve, wherein a gap remains between said drive shaft and said sleeve.

11. The liquid coating device of claim 9, wherein said sleeve has a cover which covers upper sides of said inner ring and said outer ring.

12. The liquid coating device of claim 11, wherein said cover has an edge leading liquid into a liquid outlet at a lower end of said sleeve.

13. The liquid coating device of claim 9, wherein said sleeve has a liquid outlet at a lower end thereof.

14. The liquid coating device of claim 13, wherein said liquid outlet is provided within said bearing element.

15. The liquid coating device of claim 7, wherein a lower side of said spray disk has a downwardly extending apron which is immersed into a liquid bath of said liquid tub.

16. The liquid coating device of claim 1, further comprising a liquid supply which feeds onto said spray disk from an upper direction.

17. The liquid coating device of claim 1, wherein said bearing element has peripheral grooves for a belt pulley.

18. The liquid coating device of claim 1, wherein said bearing element is comprises a labyrinth for leaking liquid.

* * * * *